US009102049B1

(12) United States Patent
Busato

(10) Patent No.: US 9,102,049 B1
(45) Date of Patent: Aug. 11, 2015

(54) ADJUSTABLE HANDLE FOR CLEANING AND COATING APPLICATION DEVICES

(71) Applicant: Giandomenico Busato, Calistoga, CA (US)

(72) Inventor: Giandomenico Busato, Calistoga, CA (US)

( * ) Notice: Subject to any disclaimer, the term of this patent is extended or adjusted under 35 U.S.C. 154(b) by 0 days.

(21) Appl. No.: 14/444,606

(22) Filed: Jul. 28, 2014

(51) Int. Cl.

| | |
|---|---|
| ***B25G 1/00*** | (2006.01) |
| ***B25G 1/06*** | (2006.01) |
| *A47L 13/42* | (2006.01) |

(52) U.S. Cl.
CPC .. *B25G 1/00* (2013.01); *B25G 1/06* (2013.01); *A47L 13/42* (2013.01)

(58) Field of Classification Search
CPC ..... B25G 1/00; A47L 13/42; A63B 53/145; A63B 49/04; Y10T 16/498
USPC ..... 15/143.1–144.1; 473/297; 16/110.1, 16/430
See application file for complete search history.

(56) References Cited

U.S. PATENT DOCUMENTS

| | | | | |
|---|---|---|---|---|
| 2,051,083 | A * | 8/1936 | Hart | 473/297 |
| 4,600,195 | A | 7/1986 | Hunter | |
| 4,940,230 | A | 7/1990 | Jian | |
| 5,904,626 | A | 5/1999 | Fendel et al. | |
| 5,993,327 | A | 11/1999 | Terril | |
| 6,196,083 | B1 | 3/2001 | Pasko et al. | |
| 6,592,756 | B1 | 7/2003 | Felix, Jr. et al. | |
| 8,444,502 | B2 | 5/2013 | Karube | |
| 2005/0261079 | A1 * | 11/2005 | Qualizza | 473/316 |

* cited by examiner

*Primary Examiner* — Laura C Guidotti

(57) ABSTRACT

A stiffened handle assembly for a cleaning device such as a broom with an internal weight whose position is adjustable by the user to change the center of gravity of the cleaning device for ease of use. As an option, the handle assembly may be attached to a broom head, mop head, or other cleaning device, or a coating application device such as a paint roller, floor wax applicator.

3 Claims, 4 Drawing Sheets

ADJUSTABLE HANDLE FOR CLEANING AND COATING APPLICATION DEVICES

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

1. Field of the Invention

The present invention relates generally to cleaning or coating application devices with long handles. More specifically, the present invention relates to a cleaning or coating application device wherein the handle includes an adjustable center of gravity to reduce operator fatigue and improve ease of use of the device.

2. Description of the Related Art

Items used for cleaning or applying coatings to floors, such as brooms, mops and wax application devices generally have a cleaning or application head attached to a handle of appropriate length that aids the operator in the sweeping, mopping, or application process without requiring extensive bending or kneeling. Similarly, items such as paint rollers, brushes and dusters that may be used to clean or apply coatings to walls or ceilings, or to clean items above the operator's head, have a cleaning or application head attached to a such a handle. Handles for such items are used by placing one hand at the furthest end from the cleaning or application head and one hand at approximately the mid-section of the length of the handle for maximum control of the head location. Such handles are generally designed to be as light as possible to reduce the strength required while using the device. Although a lighter weight handle may aid in reducing the strength required for use, however, it does not reduce operator fatigue which can occur due to the repetitive motion while in use.

Another drawback of a handle that is designed only to be light-weight is that the handles are often quite flexible due to the necessary limitations on the amount or type of material used. Higher flexibility in the handle results in inaccuracy in placement of the cleaning or application head, resulting in increased operator fatigue due to the additional energy required to position the head at the desired location.

The present invention addresses these issues by providing a stiffened handle that includes an adjustment mechanism to allow the operator to change the center of gravity of the device. By stiffening the handle, operator fatigue is reduced because the cleaning or application head can be more accurately placed. By moving the center of gravity up or down along the length of the handle, the angle of force applied by the user to repeat the same motion is varied, changing the muscles used and thereby reducing fatigue due to repetitive motion.

Another advantage of the adjustable positioning for the center of gravity of the handle is an increase in the ease of use of the same handle for cleaning or applying coatings to surfaces or items in different locations. Specifically, the operator may choose to move the center of gravity closer to the cleaning or application head when using it on the floor or lower objects, and then opt to move the center of gravity further from the cleaning or application head when using it to reach higher places. This allows the operator to make the best use of the handle's leverage in different situations.

Yet another advantage of the adjustable positioning for the center of gravity of the handle is an increase in the ease of use by the operator to improve the balance of the swinging motion relative to the operator's chosen hand positioning on the handle length. This adjustability allows the operator to alter the dynamic effect of the swinging motion, making the cleaning application device seem easier to use.

BRIEF SUMMARY OF THE INVENTION

The present invention is a Handle that has an adjustable center of gravity attached to a Cleaning or Coating Application Head wherein the Cleaning or Coating Application Head is intended to be used on surfaces or items that are difficult to reach without bending, kneeling, or using a ladder. In a preferred embodiment, the Cleaning or Coating Application Head has a threaded, or other removable connection method, to the Handle so that the same Handle may be used with a variety of Cleaning or Coating Application Heads. In other embodiments, one Cleaning or Coating Application Head, such as a broom head, mop head, wax applicator, paint roller, duster, squeegee, or the like, is permanently attached to the Handle.

The Handle consists of a Hilt that is affixed to a Securing Part and Threaded Rod; a Threaded Weight that moves up and down the Threaded Rod; and a hollow Outer Shaft that is free to rotate relative to the Hilt. The Outer Shaft and Threaded Weight have a mating bead and groove so that the Threaded Weight moves up and down relative to the Outer Shaft, but does not rotate relative to the Outer Shaft.

BRIEF DESCRIPTION OF THE SEVERAL VIEWS OF THE DRAWINGS

A more complete understanding of the present invention may be derived by referring to the detailed description and claims when considered in connection with the figures, wherein like reference numbers refer to similar items throughout the figures and:

DETAILED DESCRIPTION OF THE INVENTION

In the following detailed description of the invention, reference is made to the accompanying drawings which form a part of the disclosure and, which show by way of illustration, and not of limitation, specific embodiments by which the invention may be practiced. The drawings, the foregoing discussion, and the following description are exemplary and explanatory only, and are not intended to limit the scope of the invention or its application in any manner.

Figure 1:
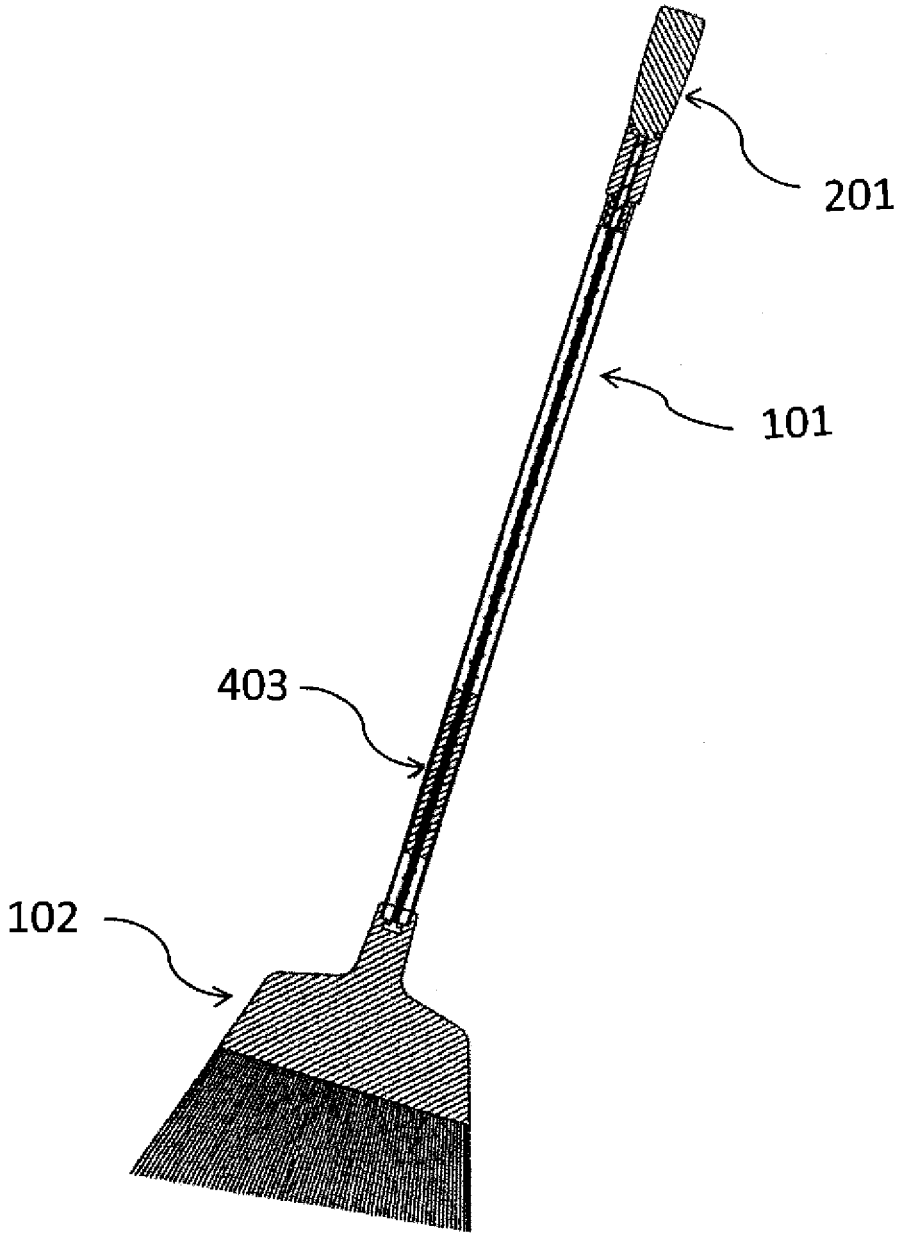
FIG. 1 is a cross-sectional view of an embodiment of the present invention, shown with a broom head installed.
Figure 2:
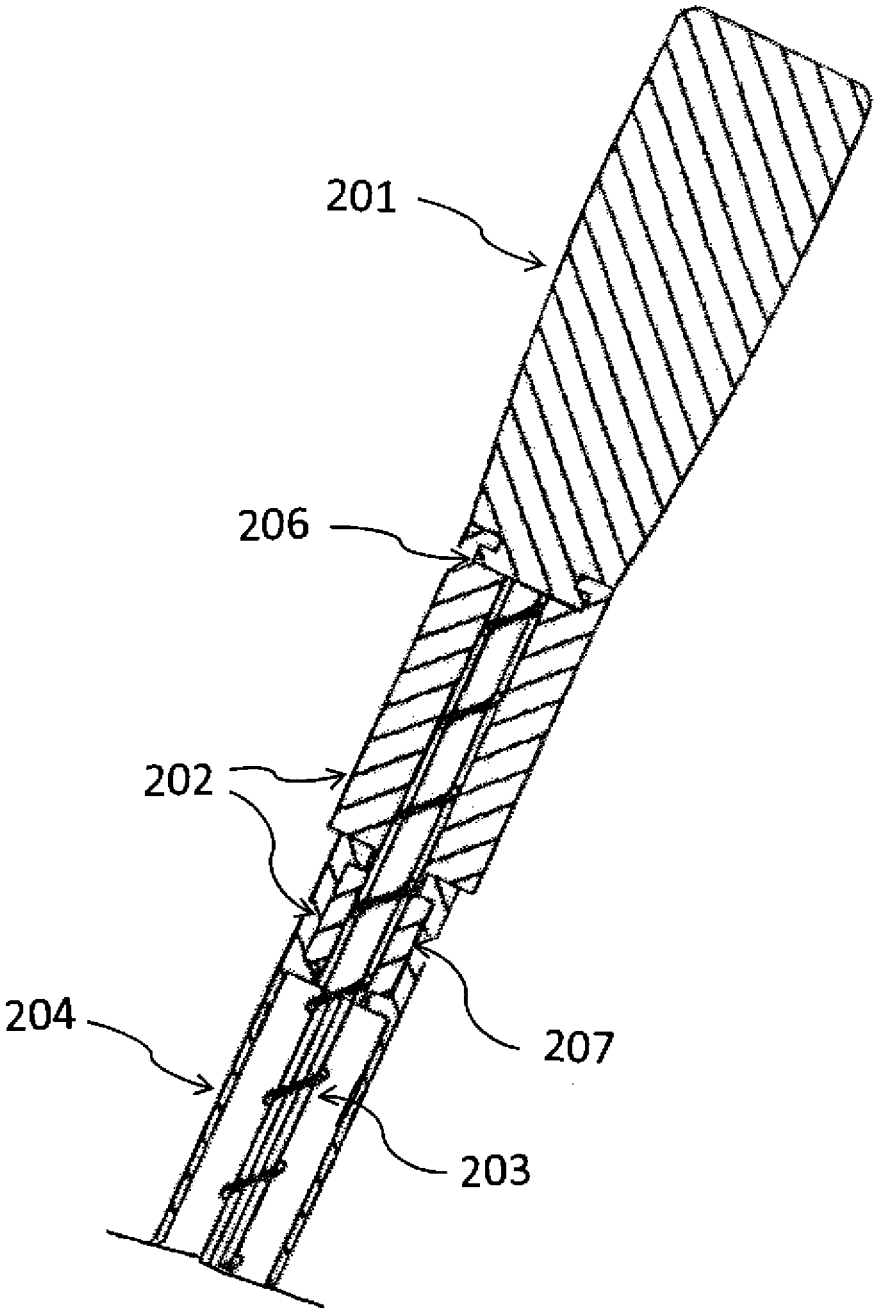
FIG. 2 is a cross-sectional view of the top section including the Hilt, the Securing Part and the top of the Threaded Rod.
Figure 3:
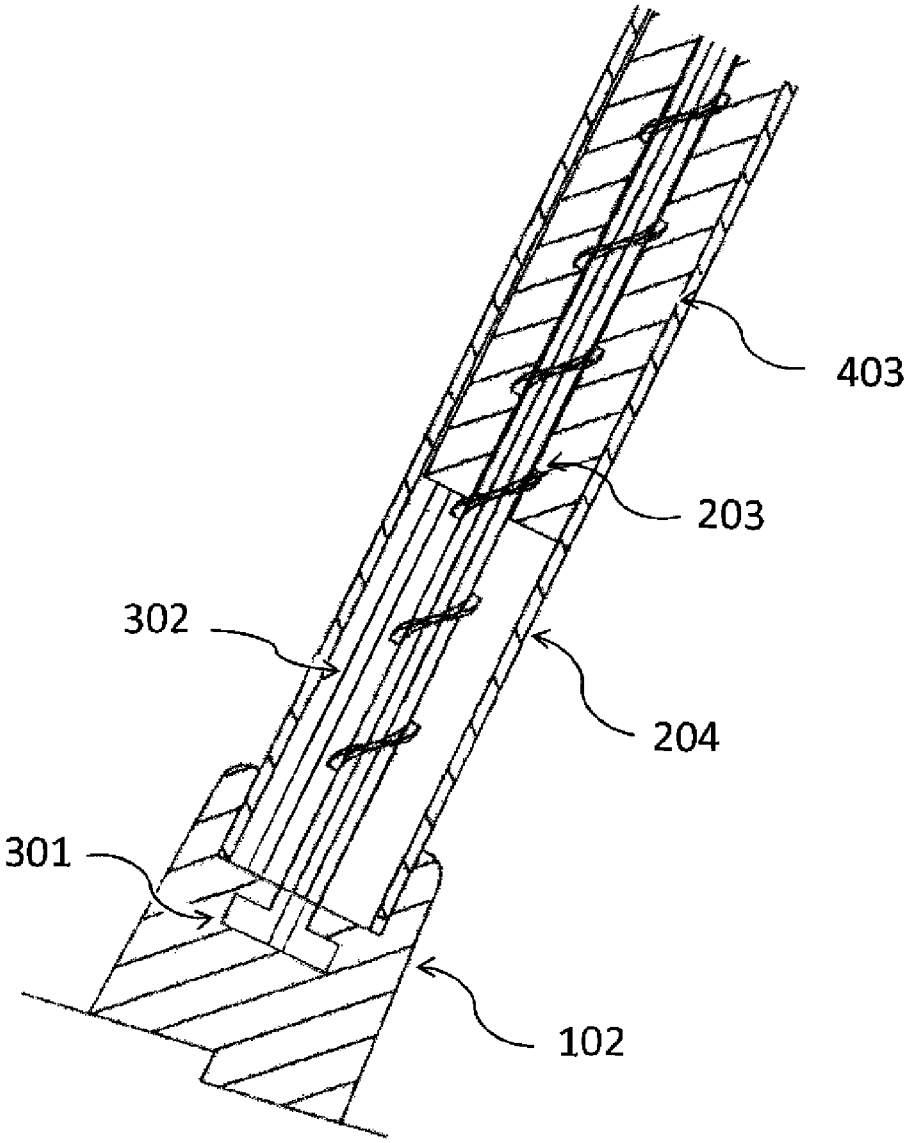
FIG. 3 is a partially cut away cross-sectional view of the connection point of the device head, shown with a broom head installed, and showing the internal groove of the Outer Shaft.
Figure 4:
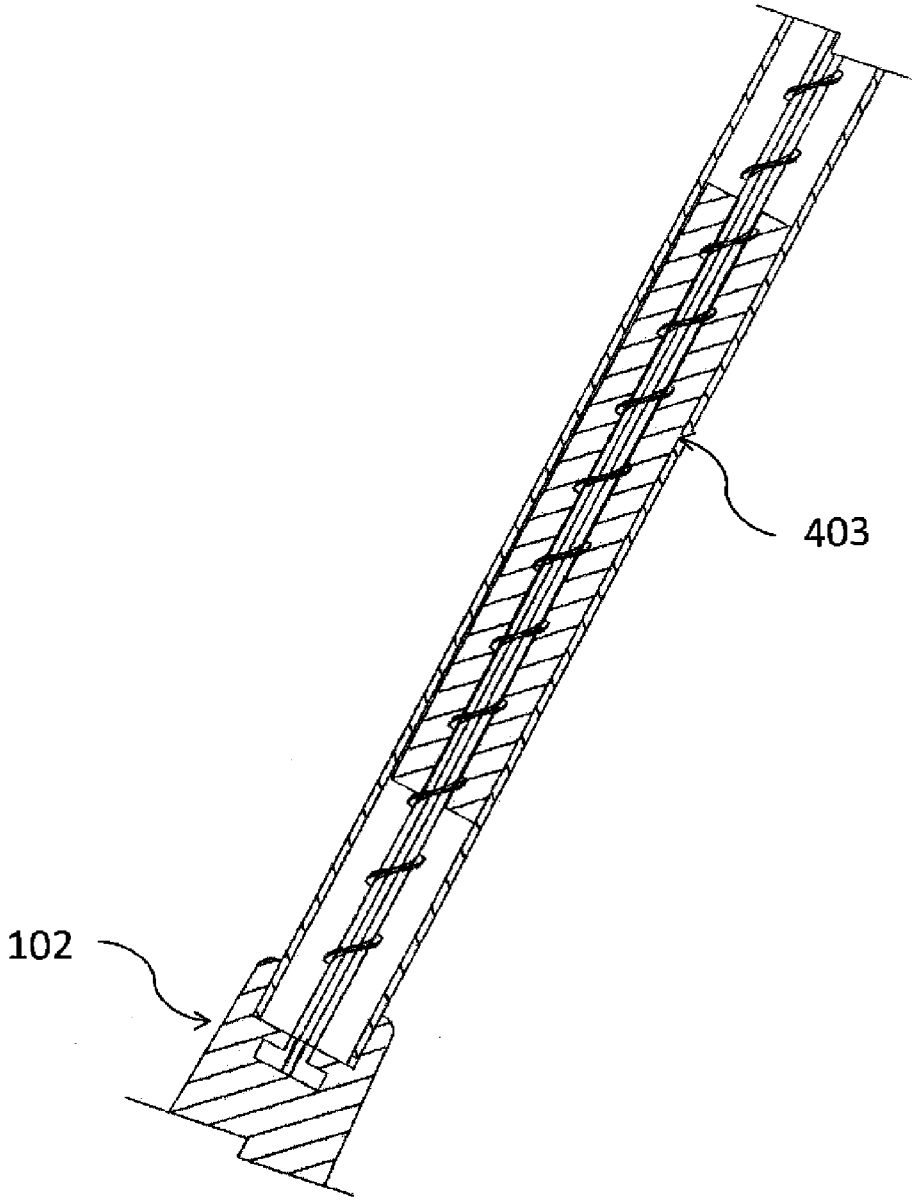
FIG. 4 is a cross-section of the Outer Shaft, the Threaded Rod, and the Threaded Weight.

The present invention is a device with a Handle 101 that has an adjustable center of gravity and an optional Cleaning or Coating Application Head 102 that may be any type of cleaning or coating application head such as a broom head, mop head, wax applicator, paint roller, duster, squeegee, or the like. In a preferred embodiment, the Cleaning or Coating Application Head 102 is attached to the Handle 101 via a threaded connection (not shown) so that it is replaceable and different Cleaning or Coating Application Heads 102 may be installed for different uses. In an alternate embodiment, as shown in FIG. 3, the connection is fixed using a Flanged End 301 of the Threaded Rod 203 with glue to prevent rotation, or using any other appropriate attachment method.

The Handle 101 consists of a Hilt 201, a Securing Part 202, a Threaded Rod 203, and an Outer Shaft 204. The Hilt 201 is preferably made from plastic, and has a smooth outer surface and a shape that is comfortable for the average user to grip. The Hilt 201 may have an internal longitudinal hole (not shown) that may extend through the entire length, or may only extend partially into the Hilt from the bottom that is properly sized to receive the end of the Threaded Rod 203. In a preferred embodiment, the Threaded Rod 203 is inserted further into the internal hole (not shown) of the Hilt 201 to provide greater stiffness and strength, although the amount of engagement may be reduced for manufacturing or adjustment purposes. The bottom of the Hilt has a Flange 206 that is properly sized to fit into a recessed area of the Securing Part 202. The Hilt 201 and Securing Part 202 are preferably made from two pieces to facilitate manufacture. If made from two pieces, the parts are permanently attached to each other with a Flange 206 type connection and glue or by any other appropriate attachment method. In an alternate embodiment, the Hilt 201 and Securing Part 202 are made from a single piece.

The Securing Part 202 is preferably made of two halves that are glued together for easy installation and connection of the Hilt 201 at the Flanged 206 area. The Securing Part 202 has a hollow center designed to accept the Threaded Rod 203. The Threaded Rod 203 is permanently attached to the Securing Part 202 with glue or other suitable attachment means. The Threaded Rod 203 is preferably made of metal, but may be made of rigid plastic that is of sufficient strength to maintain the thread shape and hold the weight of the Threaded Weight 403. The Threaded Rod 203 is of appropriate length for a standard broom handle. The bottom of the Threaded Rod 203 is preferably threaded for insertion into an internal thread (not shown) in the Cleaning or Coating Application Head 102. In an alternate embodiment, as shown in FIG. 3, the bottom of the Threaded Rod 203 is Flanged 301 for retention in a matching slot in the Cleaning or Coating Application Head 102. In that alternate embodiment, the Threaded Rod 203 and Cleaning or Coating Application Head 102 are permanently attached with glue or by other suitable method to prevent rotation of the Cleaning or Coating Application Head 102 relative to the Hilt 201.

The bottom of the Securing Part 202 has a Flange 207 to match an internal slot of the Outer Shaft 204. The Flange 207 of the Securing Part 202 rotates freely inside the Outer Shaft 204. The Outer Shaft 204 is preferably made of plastic in two halves that are glued or otherwise fused together. An internal Groove 302 extends along the length of the interior of the Outer Shaft 204. The length of the Outer Shaft 204 is designed such that when it is installed on the bottom flange of the Securing Part 202, it extends into an appropriately sized bore in the Cleaning or Coating Application Head 102, without interfering with the installation of the Threaded Rod 203 in the Cleaning or Coating Application Head 102.

The Threaded Weight 403 is preferably made of metal in two halves that are glued or otherwise fused together. The Threaded Weight 403 has an internal thread configured for installation on the Threaded Rod 203 and an external bead (not shown) protruding from the side that is designed to fit into the internal longitudinal Groove 302 of the Outer Shaft 204.

When assembled, the Hilt 201, Securing Part 202, Threaded Rod 203, and Cleaning or Coating Application Head 102, form a single assembly wherein none of the components rotate relative to each other. The Threaded Weight 403 rotates freely relative to the Threaded Rod 203, but not relative to the Outer Shaft 204. To adjust the center of gravity, the user holds the Hilt 201 in one hand and the Outer Shaft 204 with the other, and rotates the Hilt 201 relative to the Outer Shaft 204. Because the Threaded Weight 403 is fixed radially relative to the Outer Shaft 204, it will slide up or down the Threaded Rod 203 as the Hilt 201 is rotated.

Many modifications and variations of this invention may be made without departing from its spirit and scope, as will be appreciated by those skilled in the art. The specific embodiments described herein are offered by way of example only. The embodiments were chosen and described in order to best explain the principles of the invention and its practiced applications.

What is claimed is:

1. A handle assembly with an adjustable center of gravity suitable for attachment to a cleaning or coating application device head, said handle assembly comprising:

(a) a threaded rod having a top end and a bottom end, said bottom end to be configured to be installed in a cleaning or coating application device head such that said device head is secured to said threaded rod;

(b) a hilt securely attached to the top end of said threaded rod, said hilt configured to be gripped by an operator;

(c) an internally threaded weight screwed onto said threaded rod, said threaded weight being free to rotate relative to said threaded rod, and said threaded weight to have an external protrusion;

(d) a hollow outer shaft with a top end and a bottom end and an internal longitudinal groove extending the length of said outer shaft, wherein said outer shaft is installed on the outside of said threaded rod with said threaded weight installed, and the said top end of the outer shaft is inserted in said hilt with a retention means that allows it to rotate relative to said hilt, and wherein the bottom end is configured to slide into a device head such that the device head can rotate relative to said outer shaft, and the internal groove is configured to accept the external protrusion on said threaded weight such that it prevents rotation of said threaded weight relative to said outer shaft.

2. The handle assembly in accordance with claim 1, attached to a cleaning device head selected from broom, squeegee, mop, duster.

3. The handle assembly in accordance with claim 1, attached to a coating application device head selected from paint roller, floor wax applicator, stain applicator.

* * * * *